United States Patent [19]

Dick et al.

[11] Patent Number: 4,833,463

[45] Date of Patent: May 23, 1989

[54] GAS PLASMA DISPLAY

[75] Inventors: George W. Dick, Sinking Spring; Denis D. Manchon, Jr., Wyomissing, both of Pa.

[73] Assignee: American Telephone and Telegraph Company, AT&T Bell Laboratories, Murray Hill, N.J.

[21] Appl. No.: 911,930

[22] Filed: Sep. 26, 1986

[51] Int. Cl.[4] ..... G09G 3/28

[52] U.S. Cl. ..... 340/775; 340/769; 315/169.4

[58] Field of Search ..... 340/770, 769, 772, 768, 340/775; 315/169.4

[56] References Cited

U.S. PATENT DOCUMENTS

| | | | |
|---|---|---|---|
| 3,886,404 | 5/1975 | Kurahashi et al. | 340/775 |
| 3,925,703 | 12/1975 | Schermerhorn | 340/775 |
| 3,964,050 | 6/1976 | Mayer | 340/775 |
| 4,044,349 | 8/1977 | Andoh et al. | 340/775 |
| 4,160,932 | 7/1979 | Mikoshiba et al. | 340/775 |
| 4,164,678 | 8/1979 | Biazzo et al. | 313/220 |
| 4,513,281 | 4/1985 | Ngo | 340/769 |
| 4,554,537 | 11/1985 | Dick | 340/775 |
| 4,728,864 | 3/1988 | Dick | 340/775 |

OTHER PUBLICATIONS

"Color TV Display with AC-PDP", *Proc. of 3rd International Research Conference*, Kobe, Japan, 1983, pp. 514–517, Yokozawa et al.

*Primary Examiner*—Gerald L. Brigance
*Assistant Examiner*—Mahmoud Fatahiyar
*Attorney, Agent, or Firm*—Lester H. Birnbaum

[57] ABSTRACT

Disclosed is an ac plasma display of the type employing three electrodes per pel which is useful for full color displays. A phosphor layer is provided over the cover electrodes and the usual electron emission layer is eliminated or thinned down. An additional pulse is provided to the cover electrodes to aid in charge transfer during the write stage in order to compensate for the absence of significant electron emission.

8 Claims, 4 Drawing Sheets

GAS PLASMA DISPLAY

BACKGROUND OF THE INVENTION

This invention relates to ac plasma displays, and in particular to a display suitable for color graphics.

As known in the art, plasma display panels basically comprise a substrate and cover, both including dielectric layers over their major surfaces, which are placed so as to define a gap therebetween. A gas which is capable of being ionized, such as neon with 0.1 percent argon added, is sealed within the gap. The display is defined by locally induced glow discharges in the gas produced by applying a desired potential to selected electrodes in arrays embedded within the dielectric layers. Once a display site or "pel" is fired as a result of applying the appropriate potential during a "write" stage, it will remain "on" as an ac potential is applied to electrodes included within the site during a "sustain" stage due to the generation of charges on the surface of the dielectric layer. Typically, additional layers of a low work function material are provided over the dielectric layers to provide good electron emission, and thereby reduce the level of the required potential. It is also known that providing an appropriate phosphor layer over the cover electrodes can produce displays of various colors.

Recently, a display has been proposed where each pel includes the crosspoint region of three electrodes—a pair of metal electrodes formed on the substrate (Y electrodes), and an electrode running perpendicular thereto formed over the cover or over a dielectric on the substrate electrodes (X electrode). When the X electrode is placed on the cover, it preferably can be a transparent conductor material such as indium tin oxide or indium oxide. A display site is written, for example, by applying a negative pulse to a Y electrode and a positive pulse to the X electrode of the desired crosspoint region. This cause a glow discharge at that region and also results in the accumulation of negative charges on the dielectric over the X electrode and positive charges on the dielectric over the Y electrode. A positive pulse is then applied to the other Y electrode of the crosspoint region to transfer the negative charge to the dielectric layer thereover. The discharge is then sustained in the area over the Y electrode pair by applying an ac signal which causes successive glow discharges and shifts the charges back and forth over the two electrodes. The region remains "on" until erased by appropriate pulses applied to the electrodes which are of a shorter duration and less magnitude than the write pulses. (For a detailed discussion of such a display, see U.S. Pat. No. 4,554,537 issued to G. W. Dick and assigned to AT&T Bell Laboratories, which is incorporated by reference herein.)

In order to construct a color display from such a structure, it is desirable to provide phosphor layers over the cover electrodes. A typical structure would include adjacent areas of red, green and blue phosphor layers aligned with the electrode arrays so that each color pel would comprise a combination of three adjacent crosspoint regions of the type described above, each aligned with a different color phosphor. (See, e.g., M. Yokozawa et al., "Color TV Display With AC-PDP", *Proc. 3rd Int. Research Conf.*, Kobe, Japan, 1983, pp. 514–517). Thus, appropriate colors could be generated by operating the right combination of crosspoint regions in the manner previously described.

The use of a phosphor layer, however, can produce some difficulties. In particular, the usual electron emission layers provided over the cover electrodes tend to attenuate the ultraviolet light produced from the glow discharge to the extent that such light may not reach the phosphor at a sufficient intensity level. It is, therefore, desirable to either remove or reduce the thickness of the electron emission layer. However, in so doing, the voltage requirements on the electrodes are increased, and this increase can cause undesired charge storage on the cover and/or charge transfer to adjacent crosspoint regions which are not meant to be ignited. This can be particularly troublesome in view of the high line density usually required for color displays.

It is, therefore, a primary object of the invention to provide a plasma display which does not require a standard secondary emitter layer and yet results in insignificant crosstalk.

SUMMARY OF THE INVENTION

This and other objects are achieved in accordance with the invention which, in one aspect, is a display device comprising first and second substrates placed so as to define a gap region between them with a gas capable of forming a glow discharge occupying the gap. First and second arrays of electrodes are formed in the gap, covered by dielectric layers, and positioned to form crosspoint regions between the electrodes of the two arrays. The first array comprises a plurality of at least pairs of electrodes spaced in at least the crosspoint regions so that a glow discharge may be sustained at the surface of the dielectric in said regions. Means are provided for supplying a voltage selectively to the electrodes of the first and second arrays in order to select pairs of the electrodes of the first array for initiation of a display glow discharge at a desired crosspoint region by accumulation of charge on the portions of the dielectric over the selected electrodes of the first and second array. Means are also provided for supplying a voltage to another electrode in the first array in the desired crosspoint region in order to transfer the charge accumulated over the electrode in the second array to the dielectric portion over the said another electrode. Means are further included for supplying a voltage to the electrodes of the second array having an opposite polarity to the voltage applied thereto for selecting a pair of electrodes for display and in sequence with the voltage applied to the other electrode in the first array so as to contribute to the transfer of charge accumulated over the electrode in the second array to the dielectric portion over the other electrode in the first array in the desired crosspoint region.

In accordance with another aspect, the invention is a method of operating a display device of the type including first and second substrates placed so as to define a gap region between them with a gas capable of forming a glow discharge occupying the gap and further including first and second arrays of electrodes formed in the gap region, covered by dielectric layers, and positioned to form crosspoint regions comprising at least two electrodes from the first array and an electrode from the second array. The method comprises selecting a desired crosspoint region for display by applying a first pulse of one polarity to a selected electrode in the second array and a second pulse of opposite polarity to a selected first electrode in the first array in the desired crosspoint region sufficient to cause a net accumulation of charges of opposite polarities on the dielectric layers over the two electrodes. Subsequently, a third pulse having the same polarity as the first pulse is applied to a second electrode in the first array and a fourth pulse having a polarity opposite to the first pulse is applied to the electrode of the second array sufficient to transfer the charges accumulated over the electrode in the second array to the dielectric layer portion over the second electrode.

BRIEF DESCRIPTION OF THE DRAWINGS

These and other features of the invention will be delineated in detail in the following description. In the drawing.

It will be appreciated that, for purpose of illustration, these figures are not necessarily drawn to scale.

DETAILED DESCRIPTON OF THE INVENTION

Figure 1:
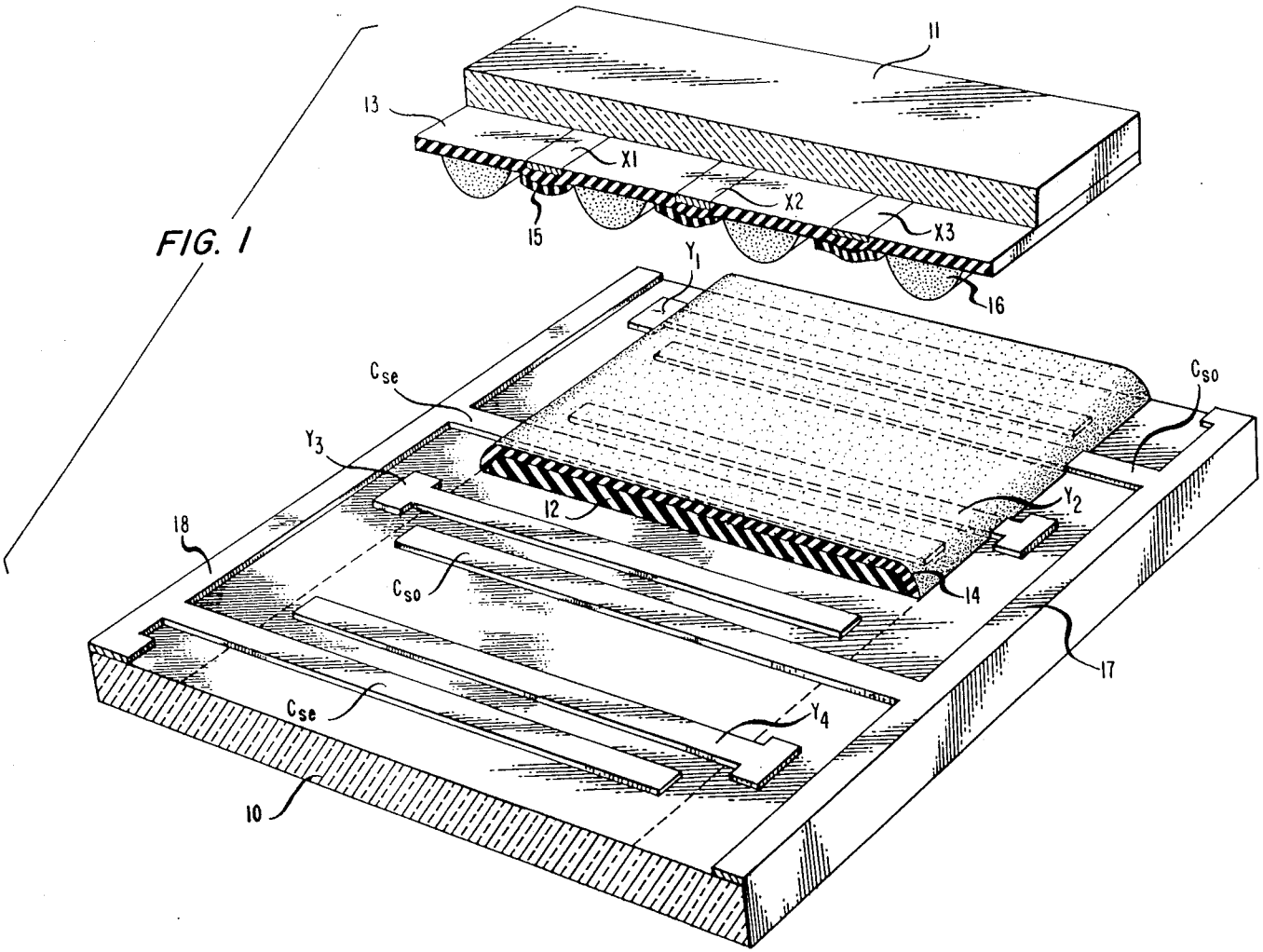
FIG. 1 is an exploded, perspective view of a portion of a display device in accordance with an embodiment of the invention.

The basic principles of the plasma display are described with reference to the exploded view of FIG. 1, which shows only a portion of the display. A 3×4 array of crosspoints is shown for purposes of illustration, but it will be appreciated that an actual display would include many more electrodes.

The device includes two insulating substrates, 10 and 11, upon which the formed arrays of electrodes (the latter substrate being typically referred to as the "cover"). The substrates are usually made of glass. Parallel electrodes $X_1$, $X_2$ and $X_3$ are formed on the surface of the top substrate, 11, while an array of parallel electrodes, $Y_1$–$Y_4$, $C_{se}$ and $C_{so}$, is formed on the bottom substrate, 10. The arrays are oriented so that the electrodes on the two substrates are essentially orthogonal. It will be noted that the array on the bottom substrate includes a plurality of pairs of electrodes. Each pair includes a first electrode ($Y_1$–$Y_4$) which may be biased independently of all other electrodes, and a second electrode ($C_{so}$ or $C_{se}$) which is coupled to a common bus (17 or 18) so that the second electrode in every odd pair ($C_{so}$) is biased in common and the second electrode in every even pair ($C_{se}$) is biased in common. This type of arrangement is advantageous for color displays which require high line densities. (See, e.g., U.S. patent application of G. W. Dick, Ser. No. 835,356, filed Mar. 3, 1986, and assigned to the present assignee, which is incorporated by reference herein.) The electrodes are typically made of aluminum and deposited by sputtering or evaporation.

The portion of each electrode in the display area is covered by a dielectric layer. In this example, the dielectric layers, 12 and 13, are low melting point solder glass approximately 1 mil thick. Formed over the dielectric (13) on the cover is an array of phosphor dots (e.g., 15) which are aligned with crosspoint regions of the electrodes of the two arrays so that every three adjacent crosspoint regions will have included therein a different one of a red, green and blue phosphor dot. Thus, in this example, the crosspoint region formed by electrodes $Y_1$, $C_{so}$ and $X_1$ might include a red phosphor, crosspoint region formed by $Y_1$, $C_{so}$, $X_2$ a green phosphor, and crosspoint region formed by $Y_2$, $C_{se}$, $X_1$ a blue phosphor. These crosspoint regions would, therefore, constitute one pixel of the color display. The crosspoint formed by $Y_1C_{so}$, $X_3$ would include a blue phosphor, the crosspoint formed by $Y_2$, $C_{se}$, $X_2$ a red phosphor, and the crosspoint formed by $Y_2$, $C_{se}$, $X_3$ a green phosphor so that these crosspoint regions would comprise another pixel in the display. This pattern of phosphors could be repeated any number of times depending on the size of the display.

The phosphor dots are formed by a standard technique such as screen printing or spraying through a stencil mask and typically have a thickness of approximately 12 microns. Any standard phosphors excited by UV radiation could be employed. For example, the green phosphor could be $Zn_2SiO_4$:Mn, the red phosphor could be (Y.Gd)$BO_3$:Eu, and the blue phosphor could be $BaMgAl_{14}O_{23}$:Eu, all of which are sold by Kasei Optonix Ltd, Oawara, Japan.

An electron emission layer, 14, such as MgO, is included over the dielectric layer, 12, on the substrate, 10. This layer is approximately 2000 angstroms thick in accordance with standard practice. It will be noted, however, that no such layer is present in the display region over the substrate 11. Since the layer has a tendency to filter out the ultraviolet radiation of the display, it is desirable to eliminate the layer. However, it is also possible to include a very thin layer of the electron emission layer over the phosphor (typically, less than 150 angstroms).

Also included over substrate 11, between the X electrodes is an array of ribs, 16, which, as known in the art, can provide isolation between adjacent crosspoint regions in the direction along the Y electrodes. In this example, the ribs are screen printed and fired to a thickness of approximately 76 microns. The ribs may be printed over the substrate, 10, rather than the cover, 11, but with the same vertical orientation as shown in FIG. 1.

The two substrates are aligned and brought sufficiently close together so that the ribs, 16, make contact with the insulating layer (12, 14) over the bottom substrate while leaving a gap at least in the areas where the two electrode arrays cross (See, e.g., FIGS. 2–5). The gap areas are evacuated and sealed, and an appropriate ionizable gas is introduced into the gaps. In this example, the gas is typically 0.2–1.6 percent xenon and the remainder neon.

Figure 6:
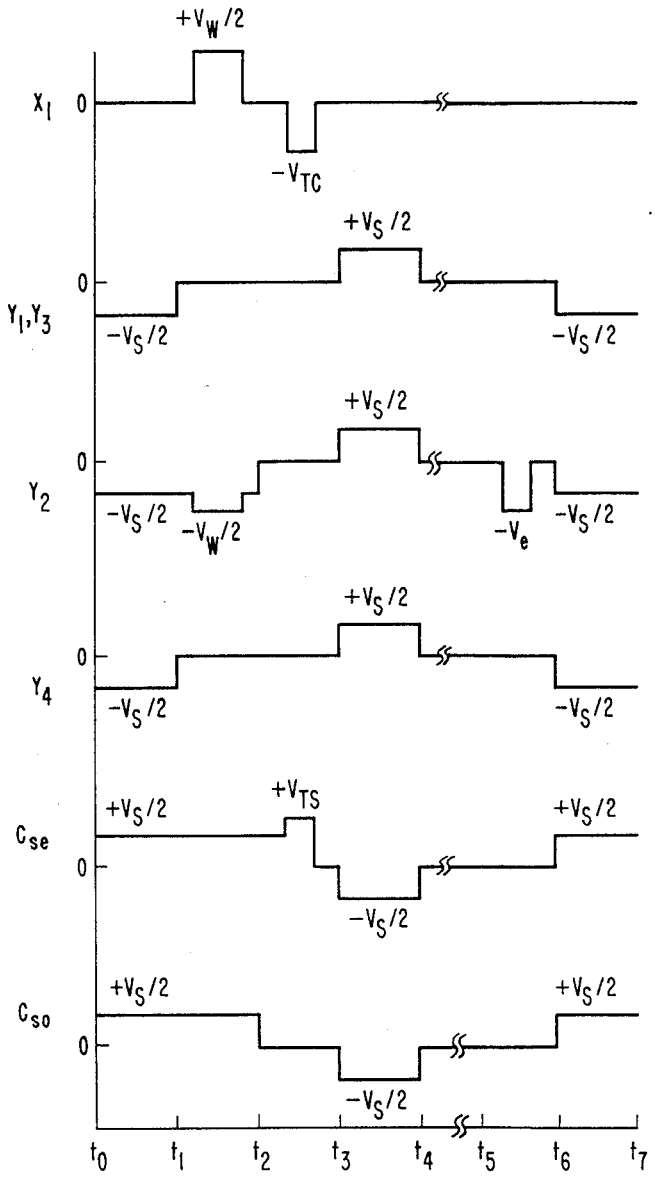
FIG. 6 is an illustration of a typical signal waveform utilized to operate the display device in accordance with the illustration of FIGS. 2–5.

The basic operation of the display is illustrated with reference to FIGS. 2–5, which are cross-sectional views along a line through electrode $X_1$, in FIG. 1, and with further reference to FIG. 6 which illustrates typical waveforms applied to the electrodes of the display. At some arbitrary time $t_o$, all electrodes are in a typical "sustain" phase where pulses with a voltage of $-V_s/2$ are applied to all Y electrodes ($Y_1$–$Y_4$) and pulses with a voltage of $+V_s/2$ are applied to the common electrodes ($C_{se}$ and $C_{so}$). $V_s$ is the desired total sustain voltage, which is typically approximately 120 volts. The duration of these pulses is approximately 10 μsec. As known in the art, ac signals applied to the array on the substrate, 10, will be insufficient to ignite a crosspoint region but will sustain a glow in those regions which have been "written" in a previous cycle as the result of accumulation and transfer of charge on the dielectric surfaces of those previously written crosspoint regions. In this example, it is assumed that the crosspoint region defined by electrodes $X_1$–$X_4$–$C_{se}$ is one such region. (Any of the othr crosspoint regions could also be written, the example shown being for illustration only.)

Figure 2:
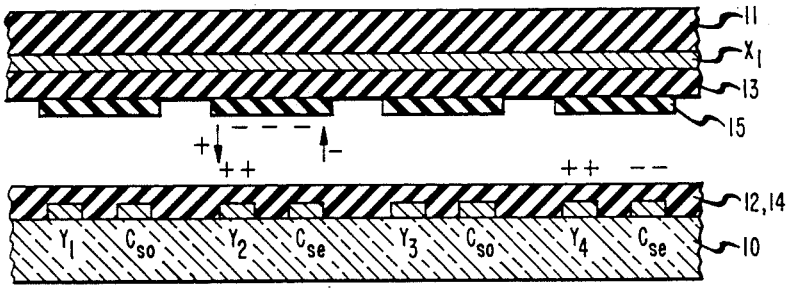
FIGS. 2–5 are cross-sectional schematic views of the device of FIG. 1 at different stages of operation in accordance with an embodiment of a further aspect of the invention.
Figure 3:
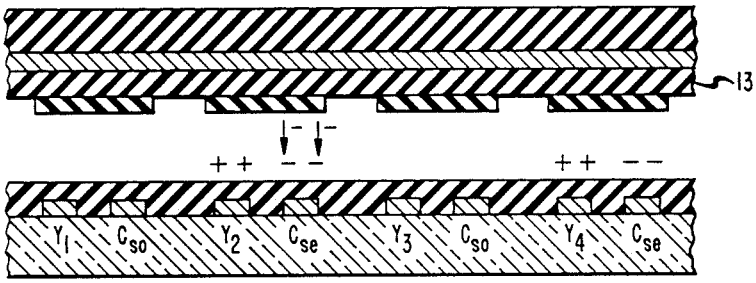

It is assumed at time $t_1$ that it is desired to ignite a glow in the crosspoint region defined by electrodes $X_1$–$X_2$–$C_{se}$. In order to accomplish this, a "write" pulse of magnitude $+V_w/2$ is applied to the selected X electrode (in this example $X_1$) while, at the same time a pulse of magnitude $-V_w/2$ is applied to the $Y_2$ electrode $V_w$ is the total desired voltage at the crosspoint to initiate a glow discharge, which in this example is approximately 160 volts. The duration of the pulse is typically approximately 8 μsec. FIG. 2. illustrates schematically the state of the crosspoint regions at the end of the write pulses (at time $t_2$). As a result of ionization of the gas and the polarity of the pulses, positive charge (represented by "+") has collected on the dielectric over electrode $Y_2$ and negative charge (represented by "−") has collected over the dielectric (phosphor) over the $X_1$ electrode. The charges shown over electrodes $Y_4$ and $C_{se}$ are there due to write and sustain pulses applied at some time prior to $t_o$. It will also be noted from FIG. 6 that the potential applied to all Y electrodes other than $Y_2$ has been lowered to zero during this write phase to prevent any glow initiation in these rows, which may be selected during a subsequent cycle.

Next, it is desired to transfer the negative charge which has accumulated over the $X_1$ electrode to the other electrode in the pair which was not pulsed during the write phase (in this example $C_{se}$). Normally, this would be done by simply applying a positive pulse such as $+V_{ts}$ in FIG. 6 to those electrodes. (See, e.g., U.S. Pat. No. 4,554,537, cited previously). However, it has been discovered that the absence of the electron emission layer (e.g., MgO) over the X electrodes requires a high voltage to be supplied to the electrodes on the substrate in order to produce sufficient transfer of charge within a reasonable time (typically 4–10 μsec). The voltage which would be required is, typically, 160 or more volts for the display in this example. The application of high voltages to the substrate electrodes $C_{se}$ could result in undesired discharges at any or all $C_{se}$–$Y_{even}$ crosspoint regions throughout the panel. Such discharges would constitute erroneous writing of these crosspoints. Consequently, in order to insure essentially complete transfer of the charge accumulated over the X electrodes, a negative pulse is applied thereto in the time interval $t_2$–$t_3$ while a positive pulse is applied to the adjacent electrode in the crosspoint region being written (in this case $C_{se}$). The transfer of charge in the desired crosspoint region is illustrated schematically in FIG. 3, which shows the state of the display at time $t_3$.

The magnitude ($V_{tc}$) of the negative pulse applied to the X electrode is typically in the range 40–100 volts and the duration is typically in the range 4–8 μsec. The exact magnitude of $V_{tc}$ will depend on whether a thin MgO layer is provided on the cover phosphors or not. With no MgO, a value of 80 volts is typically used with a duration of approximately 4 μsec. The magnitude ($V_{ts}$) of the positive pulse applied to the $C_{se}$ electrode is typically somewhat less than the transfer pulse applied to a nonphosphor 3-electrode panel and is, desirably, in the range of 80–100 volts with a duration in the range of 4–8 μsec. In this example, the magnitude is 80 volts and the duration is 4 μsec. It will be noted that since the negative pulse applied to the X electrode will only result in a discharge in crosspoint regions which also have negative surface charge due to the application of a previous write pulse ($+V_w/2$) to desired X electrodes, this negative pulse can be applied simultaneously to all X electrodes during the charge transfer phase ($t_2$–$t_3$). Thus, additional circuitry for applying these pulses is quite simple.

Figure 4:
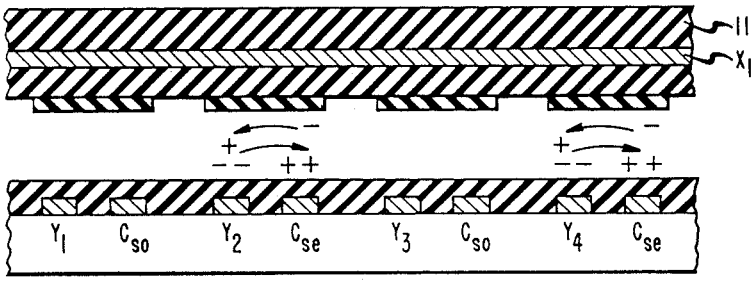
Figure 5:
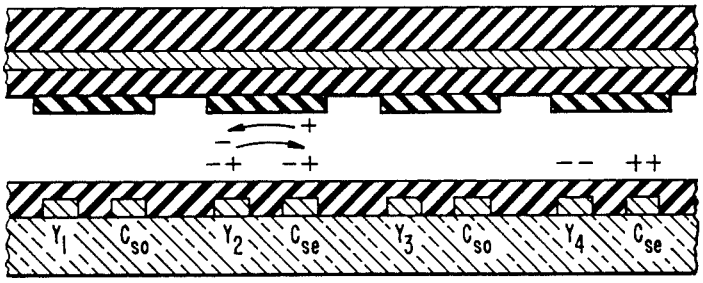

In the next time interval, $t_3$–$t_4$, the standard sustain pulses are applied to the electrodes $Y_1$–$Y_4$ and $C_{se}$, $C_{so}$ (i.e. $+V_s/2$ to $Y_1$–$Y_4$ and $-V_s/2$ to $C_{se}$, $C_{so}$). This causes discharges in the crosspoint regions previously written ($Y_2$–$C_{se}$), which was written during $t_2$–$t_3$, and $Y_4$–$C_{se}$, which was written at some time prior to $t_o$. Only these crosspoint regions will glow because of the accumulation of charges over the dielectric in those regions. The sustain pulses also cause transfer of the accumulated charges from over one electrode in each written pair to over the other electrode in each written pair as illustrated in FIG. 4, which shows the state of the display at time $t_4$.

The next interval, $t_5$–$t_6$ is shown for the purposes of illustrating erasure of the same crosspoint region, $Y_2$–$C_{se}$, previously written. This example assumes a mode of addressing which is compatible with typical CRT display controller interfaces. In this case, each row of the panel must be sequentially erased and then rewritten with new data or, if unchanged, the same data as was displayed during the previous picture scan. Thus, the data written at time $t_1$–$t_3$ would normally be sustained for several sustain cycles before being erased as shown here at time $t_5$–$t_6$.

In order to erase the desired crosspoint regions, a pulse with a potential of $-V_e$ is applied to one of the electrodes in the pair which constitutes the line to be erased, in this example, electrode $Y_2$. The pulse is of a polarity, magnitude and duration which will create a weak sustain-like discharge at all active crosspoints along the $Y_2$–$C_{se}$ pair, but will result in only a partial or neutralizing charge transfer of dielectric charge. This is illustrated schematically in FIG. 5 which shows the state of the display at time $t_6$. The crosspoint region defined by electrodes $Y_4$–$C_{se}$ remains unaffected since no erase pulse has been applied to $Y_4$ in this cycle. The pulse, $-V_e$, typically has a magnitude of approximately 70 V and duration of approximately 4 μsec.

In the next interval, $t_6$–$t_7$, the standard sustain pulses are again applied to all electrodes. In succeeding intervals, not shown, selected crosspoint regions may be erased and written line-by-line, usually sequentially, in the same manner illustrated for the $Y_2$–$C_{se}$ line. The only difference would be that for rows including the odd Y electrodes, the transfer pulse, $V_{ts}$, would be applied to $C_{so}$ rather than $C_{se}$.

Figure 7:
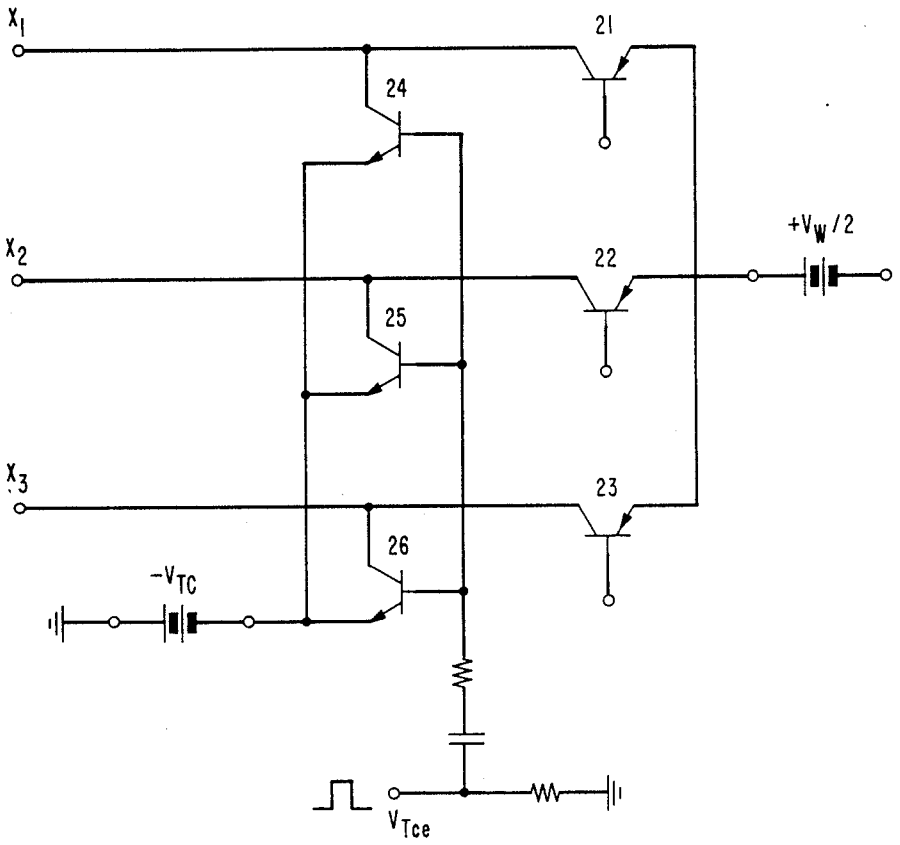
FIG. 7 is a circuit diagram of a circuit useful for operating the display in accordance with the embodiment of FIGS. 2–5.

FIG. 7 is an example of circuitry which could be used to bias the cover (X) electrodes in accordance with the invention. As shown, the write pulse $V_w/2$ could be supplied by a simple dc source which is coupled to switches illustrated as bipolar transistors 21, 22 and 23. The source is coupled to the emitters of these transistors. The collector of each transistor, 21, 22 and 23, is coupled to one of the X electrodes, in this example to $X_1$, $X_2$, and $X_3$, respectively. The base of each transistor is coupled to logic circuitry (not shown) so that an enabling pulse is applied thereto at an appropriate time to make that transistor conductive and thereby apply the $V_w/2$ potential to the selected X electrode. In some modes of operation, it may be desirable to also provide an erase pulse to the X electrodes, in which case circuitry could be added to provide either the write or erase pulse to the switches 21–23. (See, e.g., U.S. Pat. No. 4,554,537, previously cited).

In order to apply the transfer pulse ($-V_{tc}$), to the X electrodes, three additional transistors 24, 25, and 26 are provided. The emitters of these transistors are coupled to the dc source supplying the $-V_{tc}$ potential. The collector of each transistor is coupled to a different one of the X electrodes, in this case the collectors of 24, 25 and 26 are applied, respectively, to $X_1$, $X_2$, and $X_3$. The base of each transistor is coupled in common to a terminal at which is supplied, at an appropriate time, an enabling pulse ($V_{tce}$) which is sufficient to make each transistor conduct (typically, 5 volts). This results in the simultaneous application of the $-V_{tc}$ potential to all X electrodes.

It will be appreciated that bipolar switches are shown for illustrative purposes and other types of switches, such as FETs, could be employed.

The substrate electrodes (Y, $C_{so}$ and $C_{se}$) can be addressed by standard circuitry, one example of which is shown in U.S. patent application of G. W. Dick, Ser. No. 835,366, previously cited.

It will be appreciated that, although the invention has been described with reference to a display with each crosspoint region having a pair of electrodes on the substrate and one electrode on the cover, some variations are possible. For example, the X electrodes would be formed over the substrate and separated from the Y and C electrodes by a dielectric to form a "single substrate" design. (See, for example, U.S. Pat. No. 4,164,678 issued to Biazzo et al.) Further, each crosspoint region could include at least one additional electrode coplanar with the Y and C electrodes. (See U.S. Pat. No. 4,554,537, previously cited.)

It should also be appreciated that, rather than form an array of different color phosphors on the cover, a single, uniform phosphor could be used if a single color is desired. Also, it may be possible to eliminate the dielectric layer, 13, on the cover so that only the phosphor layer serves as a dielectric over the X electrodes. The present invention may also be advantageous where no phosphor is used (noncolor display) and only a thin layer of a secondary emission layer (less than 150 angstroms) is formed or no such layer is used.

Various additional modifications will become apparent to those skilled in the art. All such variations which basically rely on the teachings through which the invention has advanced the art are properly considered within the scope of the invention.

What is claimed is:

1. A display device comprising:

first and second substrates placed so as to define a gap region between them with a gas capable of forming a glow discharge occupying the gap;

first and second arrays of electrodes formed in the gap region, covered by dielectric layers, and positioned to form crosspoint regions between the electrodes of the two arrays, said first array comprising a plurality of at least pairs of electrodes spaced in at least the crosspoint regions so that a glow discharge may be sustained at the surface of the dielectric in said regions;

means for supplying a voltage selectively to the electrodes of the first and second arrays in order to select pairs of the electrodes of the first array for initiation of a display glow discharge at desired crosspoint regions by accumulation of charge on the portions of the dielectric over the selected electrodes of the first and second array;

means for supplying a voltage to another electrode in the first array in the desired crosspoint regions in order to transfer the charge accumulated over the electrode in the second array to the dielectric portion over the said another electrode while maintaining the charge accummulated over the selected electrode in the first array, and means for supplying a voltage to the electrodes of the second array having an opposite polarity to the voltage applied thereto for selecting a pair of electrodes for display and in sequence with the voltage applied to said another electrode in the first array so as to contribute to the transfer of charge accumulated over the electrode in the second array to the dielectric portion over the said another electrode in the desired crosspoint regions.

2. The device according to claim 1 wherein at least the first array of electrodes is formed over the first substrate, and the device further comprises a phosphor layer formed over the second substrate.

3. The device according to claim 2 wherein, in addition to said phosphor, the dielectric layer over said second substrate consists essentially of a material which does not provide significant electron emission.

4. The device according to clam 3 wherein the electrodes of the second array are formed on said second substrate.

5. The device according to claim 1 wherein at least the first array of electrodes is formed over the first substrate and an electron emission layer with a thickness of less than 150 angstroms is formed over the second substrate.

6. A method of operating a display device which includes first and second substrates placed so as to define a gap region between them with a gas capable of forming a glow discharge occupying the gap and first and second arrays of electrodes formed in the gap region, covered by dielectric layers, and positioned to form crosspoint regions comprising at least two electrodes from the first array and an electrode from the second array, the method comprising selecting a desired crosspoint region for display including the steps of:

applying a first pulse of one polarity to a selected electrode in the second array and a second pulse of opposite polarity to a selected first electrode in the first array in the desired crosspoint region sufficient to cause a net accumulation of charges of opposite polarities on the dielectric layers over the to electrodes; and subsequently, applying a third pulse to a second electrode in the first array having the same polarity as the first pulse and a fourth pulse to the electrode of the second array having a polarity opposite to the first pulse sufficient to transfer the charges accumulated over the electrode in the second array to the dielectric layer portion over the second electrode while maintaining the charge accumulated over the selected first electrode of the first array.

7. The method according to claim 6 wherein said fourth pulse is applied simultaneously to all electrodes of the second array.

8. The method according to claim 6 wherein the magnitude of the fourth pulse is in the range 40–100 V and the duration in the range 4–8 μsec.

* * * * *